US006213061B1

(12) United States Patent
Bartolazzi et al.

(10) Patent No.: US 6,213,061 B1
(45) Date of Patent: Apr. 10, 2001

(54) CONTROL SYSTEM FOR MINIMIZING ELECTRICITY CONSUMPTION IN A COOLING SYSTEM OF AN INTERNAL COMBUSTION ENGINE

(75) Inventors: Andrea Bartolazzi, Rome; Antonio Cicirello, Collegno, both of (IT)

(73) Assignee: Gate S.P.A., Torino (IT)

( * ) Notice: Subject to any disclaimer, the term of this patent is extended or adjusted under 35 U.S.C. 154(b) by 0 days.

(21) Appl. No.: 09/299,078

(22) Filed: Apr. 26, 1999

(30) Foreign Application Priority Data

Apr. 24, 1998 (IT) ..... T098A0348

(51) Int. Cl.[7] ..... F01P 7/02
(52) U.S. Cl. ..... 123/41.12
(58) Field of Search ..... 123/41.12, 41.44, 123/41.49

(56) References Cited

U.S. PATENT DOCUMENTS 4,475,485 * 10/1984 Sakakibara et al. ..... 123/41.05
4,726,325 2/1988 Itakura .
5,079,488 * 1/1992 Harms et al. ..... 318/471
5,724,924 * 3/1998 Michels ..... 123/41.12
6,032,618 * 3/2000 Ferrari et al. ..... 123/41.1

FOREIGN PATENT DOCUMENTS 0 578 564 1/1994 (EP) .
0 731 260 9/1996 (EP) .
2-136546 5/1990 (JP) .

* cited by examiner

*Primary Examiner*—Willis R. Wolfe
*Assistant Examiner*—Katrina B. Harris
(74) *Attorney, Agent, or Firm*—Sughrue, Mion, Zinn Macpeak & Seas, PLLC

(57) ABSTRACT

The system includes a sensor operable to supply electrical signals indicating the temperature of the engine and further sensors operable to supply electrical signals indicating predetermined parameters established to define operating conditions of the motor vehicle. A processing and control unit is provided to select, on the basis of the signals supplied by the said further sensors, a corresponding predetermined function which correlates the electric power to be supplied to the fan assembly with the electric power to be supplied to the electric pump, in dependence on the heat energy extracted from the engine, in order to obtain the minimum sum of the said electric power values; and to determine, on the basis of the signals supplied by the first sensor and the said selected function, the values of electric power to be supplied to the electric fan and the electric pump.

1 Claim, 3 Drawing Sheets

CONTROL SYSTEM FOR MINIMIZING ELECTRICITY CONSUMPTION IN A COOLING SYSTEM OF AN INTERNAL COMBUSTION ENGINE

BACKGROUND OF THE INVENTION

The present invention relates to a control system for the cooling system of the internal combustion engine of a motor vehicle.

More specifically, the subject of the invention is a control system for a cooling system which comprises a liquid-based cooling circuit including a radiator with an associated electrically-powered fan assembly and at least one electric pump operable to cause the coolant liquid to flow through the radiator and the internal combustion engine.

SUMMARY OF THE INVENTION

The object of the present invention is to provide a control system for a cooling system of this type, operable to reduce to the minimum the electric power required to extract the desired amount of heat from the internal combustion engine.

BRIEF DESCRIPTION OF THE DRAWINGS

Further characteristics and advantages of the invention will become apparent from the detailed description which follows, provided purely by way of non-limitative example, with reference to the appended drawings, in which.

DETAILED DESCRIPTION OF THE INVENTION

Figure 1:
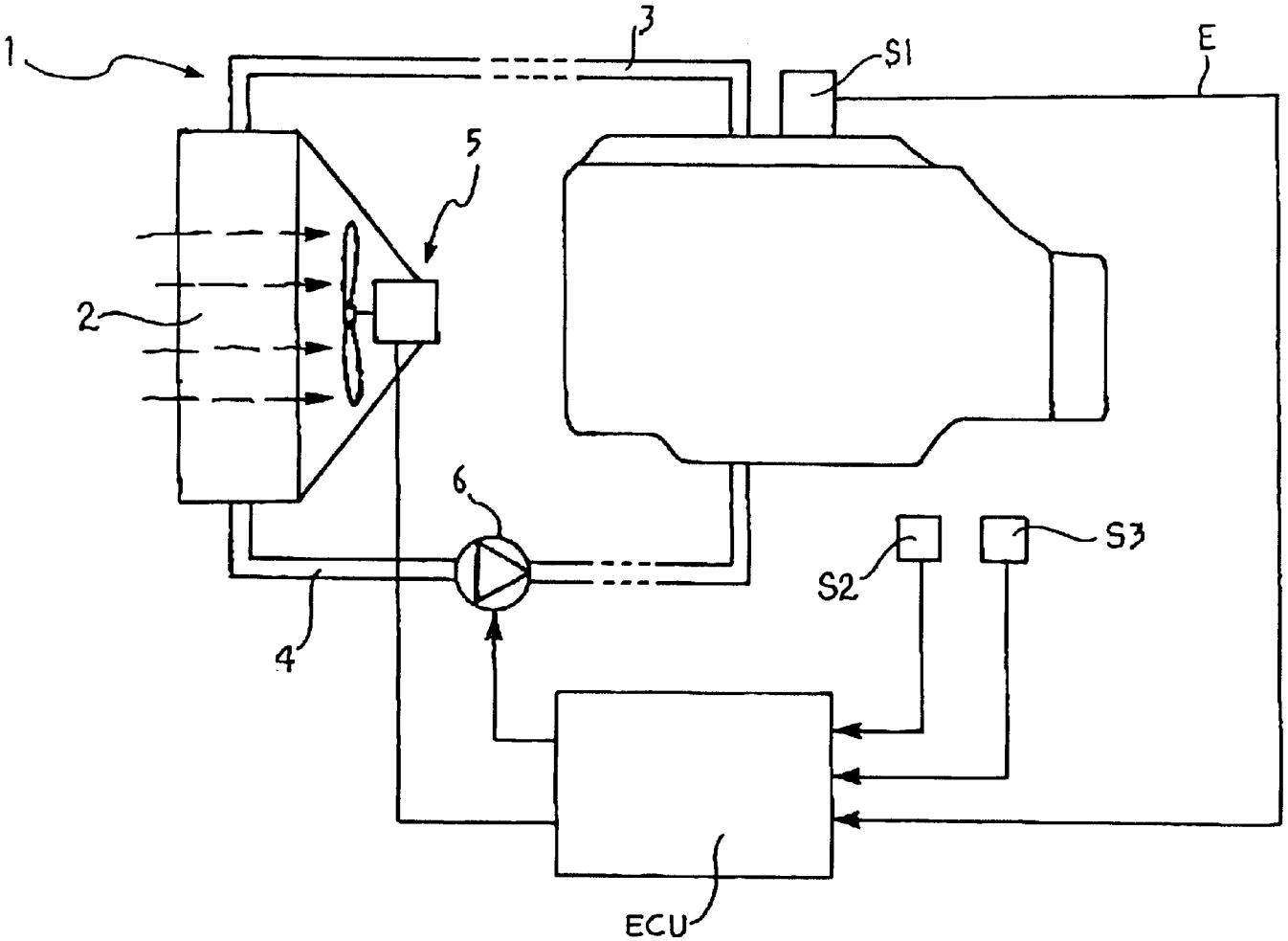
FIG. 1 is a block diagram of a cooling system for an internal combustion engine with a control system according to the invention.

In FIG. 1, an internal combustion engine for a motor vehicle is generally indicated E, A circulating-liquid cooling system associated with the said engine is generally indicated 1.

The cooling system 1 comprises a liquid-based cooling circuit including a radiator 2 connected to the engine E by pipes 3 and 4. An electric fan 5 for drawing a flow of air through the radiator 2 is connected to this radiator by known means.

The liquid cooling circuit also includes at least one electric pump, indicated 6, for circulating the liquid.

The electric fan 5 and the electric pump 6 are controlled by an electronic control unit ECU in dependence on signals received by the said unit from a plurality of sensors.

In particular, the control unit ECU is connected with (for example) a sensor S1 operable to supply electric signals indicating the temperature of the engine E, a sensor S2 operable to transmit signals indicating the speed of the vehicle and a sensor S3 supplying signals indicating the temperature of the ambient air, that is of the air outside the motor vehicle.

As will be seen more clearly later, the control unit ECU is set to control the electric fan 5 and the electric pump 6 so as to optimize the reduction in the overall electric power to be supplied to the said fan 5 and pump 6 in order to cool the internal combustion engine E as required.

The modus operandi of the control unit ECU is based on the considerations explained hereinafter with reference to FIG. 2.

Figure 2:
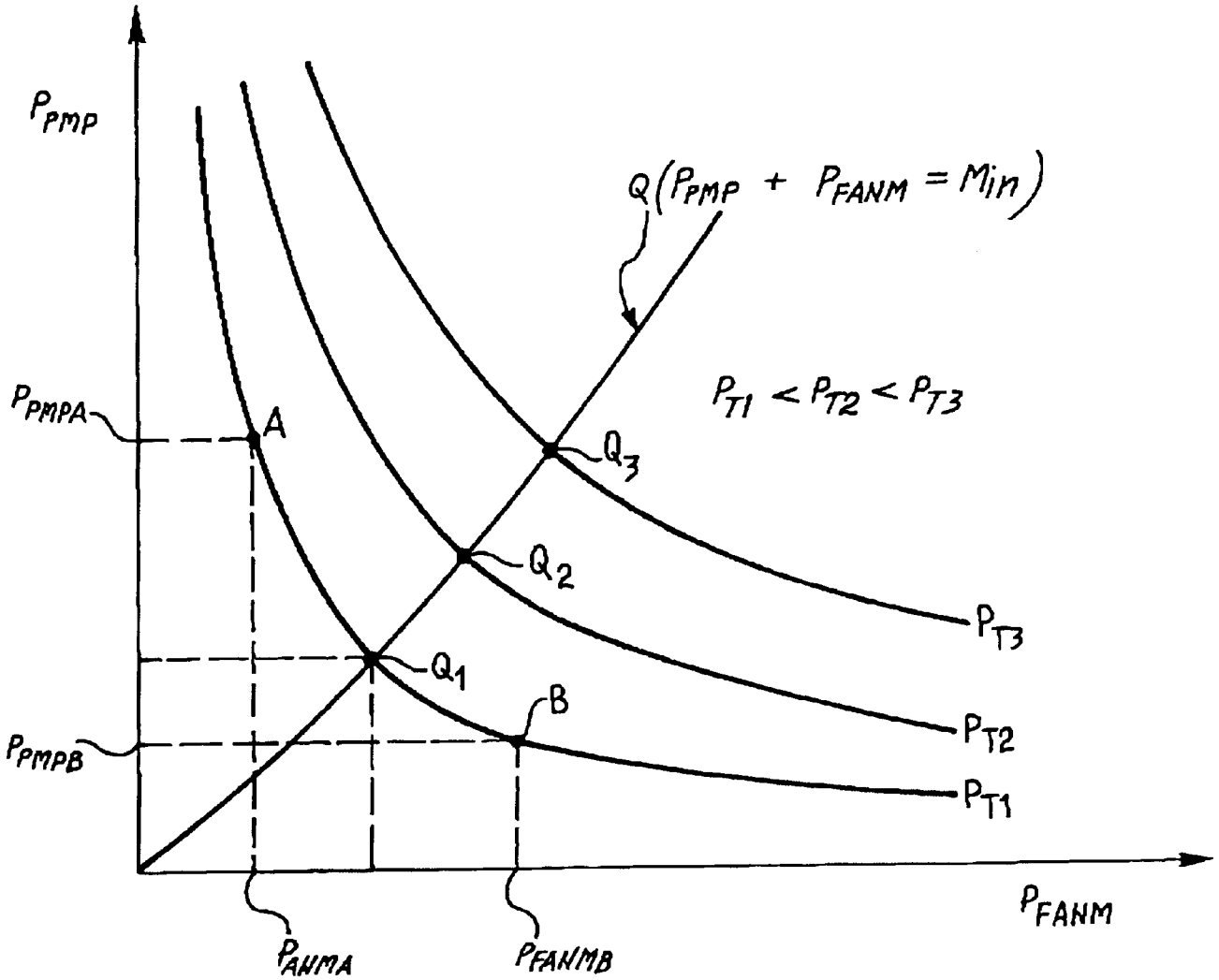
FIG. 2 is an exemplary graph, which illustrates the qualitative relationship between the electric power to be supplied to an electric pump and to an electric fan respectively in a cooling system for an internal combustion engine, in dependence on the heat to be extracted from the engine.

In the graph of FIG. 2 the electric power $P_{FANM}$ supplied to the electric fan 5 is plotted on the abscissa, while the electric power $P_{PMP}$ supplied to the electric pump 6 is plotted on the ordinate. In the graph, the curves indicated $P_{T1}$, $P_{T2}$ $P_{T3}$ correspond to constant values of beat energy P extracted from the engine E by the cooling system described above. The given curves correspond to three different heat energy values, where $P_{T1}<P_{T2}<P_{T3}$.

The significance of the curves shown in FIG. 2 is as follows. With reference, for example, to the curve $P_{T1}$, this curve defines the pair of values $P_{PMP}$, $P_{FANM}$ which enable heat energy to the value $P_{T1}$ to be extracted from the internal combustion engine E. The heat energy $P_{T1}$ can thus be extracted from the engine by supplying the pump 6 with electric power to the value $P_{PMPA}$ while simultaneously supplying the electric fan 5 with electric power to the value $P_{FANMA}$ (point A on the curve $P_{T1}$) or (for example) by supplying the pump 6 with electric power $P_{PMPB}$ and simultaneously supplying the fan 5 with electric power $P_{FANMB}$ (point B). The working point indicated A in FIG. 2 corresponds to a total electricity consumption equal to the sum of the electric power values $P_{PMPA}$ and $P_{FANMA}$. In the same way, the working point B corresponds to a total electricity consumption equal to the sum of the electric power value $P_{PMPB}$ and the electric power value $P_{FANMB}$.

For a given value $P_{T1}$ (for example) of the heat energy to be removed from the engine E, there is an optimum working point, indicated $Q_1$ in FIG. 2, which corresponds to a minimum total electricity consumption. In other words, the point $Q_1$ is the working point on the curve $P_{T1}$ where the sum of the electric power values supplied to the electric fan and the electric pump is a minimum.

Similar optimum working points, corresponding to minimum electricity consumption, exist along each of the curves $P_T$=constant: in FIG. 2 the working point corresponding to minimum electricity consumption for the curves $P_{T2}$ and $P_{T3}$ are indicated $Q_2$ and $Q_3$ respectively.

In the graph of FIG. 2, the optimum working points $Q_1$ form a curve indicated Q. This curve represents the locus of the working points of minimum total electricity consumption. Each operating condition of the vehicle can be computed by means of the value of the air temperature outside the vehicle and the instantaneous speed thereof.

Figure 3:
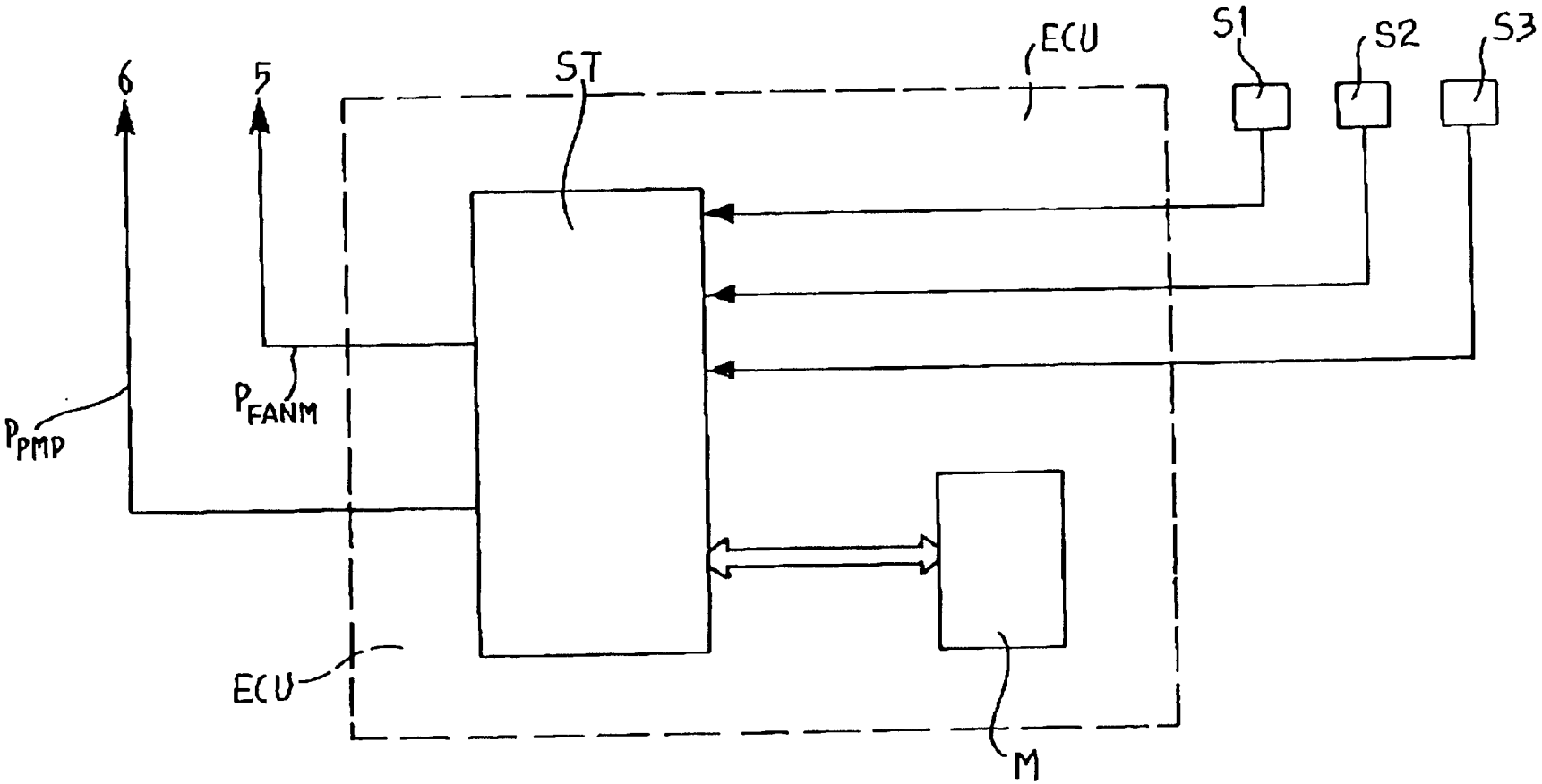
FIG. 3 is a block diagram illustrating the structure of a part of the control system of FIG. 1.

With reference to FIG. 3, the control unit ECU includes a processing and control stage ST with an associated memory M.

The processing stage ST receives the signals transmitted by the sensors S1 to S3 and is connected to a memory M storing values representing the corresponding curves Q defined above for a plurality of different operating conditions of the vehicle.

The stage ST is operable to control activation of the electric pump 6 and the electric fan 5, in particular to control the electric power supplied to each respectively.

In operation, the processor stage ST receives signals from the sensors S2 and S3 which identify the instantaneous operating condition of the motor vehicle, and the signal from the sensor S1 which indicates the temperature of the engine E.

On the basis of the signals supplied by the sensors S2 and S3, the processor stage ST selects from the memory M the values of a corresponding predetermined function expressing the curve Q which represents the locus of the working point of minimum total electricity consumption for that particular operating condition.

Once the said curve Q has been identified, at the start of the control operation, the stage ST supplies the electric pump 6 (or the electric fan 5) with a predetermined, relatively low, value of electric power and supplies the electric fan (or the electric pump) with the value of electric power that corresponds to the power supplied to the electric pump 6 (electric fan 5) according to the curve Q relating to that instantaneous operating condition. The stage ST then checks the temperature of the engine E (reported by the sensor S1) and if this should be higher (lower) than a predetermined reference value, initiates an increase (decrease) in the electric power supplied to the pump 6 and the fan 5, moving their working point along the previously determined curve Q.

The curve Q which is used to obtain feedback to control the temperature of the engine E can be changed when the signals supplied to the stage ST from the sensors S2 and S3 indicate that a noticeable change has taken place in at least one of the two parameters identifying the operating condition of the vehicle: that is the speed thereof and the outside air temperature.

The values of electric power that must be supplied at any one time to the electric fan and to the electric pump can be controlled, for example by means of modulation of the duty cycle of the voltage supplied to this equipment.

The control system described above enables the cooling system to work at optimum efficiency, thus ensuring that electricity consumption is kept to a minimum for every operating condition.

Naturally, the principle of the invention remaining the same, embodiments and manufacturing details can be varied widely from those described and illustrated here purely by way of non-limitative example, without departing thereby from the scope of the present invention, as claimed in the appended claims.

In particular, the scope of the invention covers a system in which two electric fans, or one electric fan unit with two fans operated by the same electric motor, are associated with the radiator.

What is claimed is:

1. A control system for a cooling system of an internal combustion engine of a motor vehicle, which includes a liquid cooling circuit including a radiator with an associated electrically-operated fan assembly and at least one electric pump operable to set up a flow of cooling liquid through the radiator and the engine; the control system including first sensor means operable to supply electrical signals indicating the temperature of the engine;

second sensor means including a sensor to supply electrical signals indicating the ambient temperature and a sensor to supply electrical signals indicting the speed of the vehicle;

processing and control means connected to the first and second sensor means; and memory means connected to said processing and control means, said memory means having stored therein a plurality of pre-determined functions each of which includes pairs of values of electric power to be supplied to the pump and to the fan respectively according to variations in the heat energy generated by the engine, the ambient temperature and the speed of the vehicle;

wherein said processing and control means selects, on the basis of the signals supplied by the second sensor means, one of said predetermined functions which, in dependence on the heat energy extracted from the engine, correlates the electric power to be supplied to the fan assembly and the electric power to be supplied to the electric pump in order to achieve a minimum sum of said electric power values and determines on the basis of the signals supplied by the first sensor means and the selected said function, the values of electric power to be supplied to the electric fan and to the electric pump.

* * * * *